US005361451A

United States Patent [19]

Fehrer

[11] Patent Number: 5,361,451

[45] Date of Patent: Nov. 8, 1994

[54] APPARATUS FOR MAKING A NONWOVEN WEB

[76] Inventor: Ernst Fehrer, Auf der Gugl 28, A-4020 Linz, Austria

[21] Appl. No.: 78,017

[22] Filed: Jun. 15, 1993

[30] Foreign Application Priority Data

Jun. 26, 1992 [AT] Austria ..... 1304/92

[51] Int. Cl.[5] ..... D01G 25/00; D01G 27/00

[52] U.S. Cl. ..... 19/304; 19/307

[58] Field of Search ..... 19/106 R, 108, 109, 19/144, 148, 161.1, 296, 301, 303, 304, 307, 308; 156/62.4; 425/82.1, 83.1

[56] References Cited

U.S. PATENT DOCUMENTS

| | | | |
|---|---|---|---|
| 3,481,005 | 12/1969 | Owens et al. | 19/307 X |
| 3,766,607 | 10/1973 | Jende et al. | 19/307 |
| 3,787,930 | 1/1974 | Allen | 19/308 X |
| 3,973,291 | 8/1976 | Kolbach | 19/148 |
| 4,662,032 | 5/1987 | Thorbjörnsson | 19/304 X |

FOREIGN PATENT DOCUMENTS

| | | | |
|---|---|---|---|
| 323269 | 7/1957 | Denmark | 19/308 |
| 1396985 | 3/1965 | France | 19/307 |
| 1241319 | 5/1967 | Germany | 19/307 |
| 2104213 | 11/1971 | Germany | 19/307 |

*Primary Examiner*—Clifford D. Crowder
*Assistant Examiner*—John J. Calvert
*Attorney, Agent, or Firm*—Collard & Roe

[57] ABSTRACT

To make a bulky nonwoven web of low density and high uniformity with an apparatus comprising a toothed opening roller rotatable at a sufficient speed to throw off a stream of fibers centrifugally and deposit them on a revolving air-permeable collecting surface member which has a fiber-receiving portion and a suction box having an opening underneath this portion, a guide roller is spaced vertically from the fiber-receiving portion. The guide roller is rotated in a direction opposite to that of the opening roller and has a leading peripheral surface portion facing the opening roller and projecting into the stream of fibers to deflect a part of the fibers, and a trailing peripheral portion constituting a suction zone facing the fiber-receiving portion. A guide wall in the suction box opening controls the air stream sucked through the fiber-receiving portion in the direction of the movement of the collecting surface member.

5 Claims, 1 Drawing Sheet

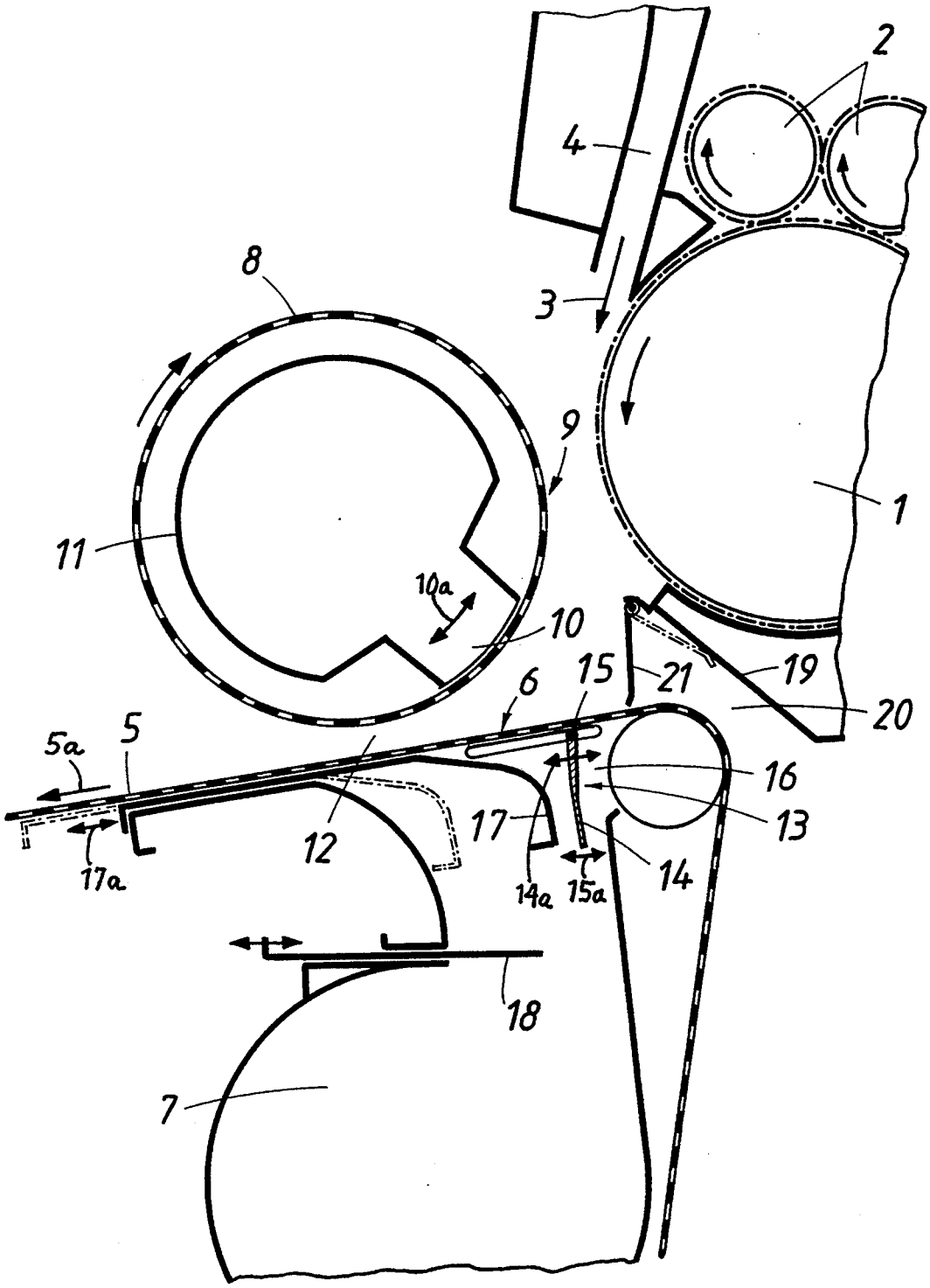
2
4
3
8
9
1
11
10a
10
15
21
19
6
20
5a
5
16
13
17
12
17a
14a
15a
14
18
7

APPARATUS FOR MAKING A NONWOVEN WEB

BACKGROUND OF THE INVENTION

1. Field of the Invention

This invention relates to an apparatus for making a nonwoven web comprising a toothed opening roller for opening a lap, which roller is adapted to be driven at such a surface speed that the fibers of the opened lap are thrown off under centrifugal force, a revolving air-permeable collecting surface member which has an at least substantially flat fiber-receiving portion, and a suction box, which adjoins said fiber-receiving portion of the collecting surface member on the side which is remote from the opening roller.

2. Description of the Prior Art

In apparatuses of that kind the toothed opening roller is used to disintegrate the lap into individual fibers, which are detached from the opening roller, preferably with the assistance of a blown air stream that is directed tangentially to the opening roller, and in a freely flowing state are deposited on a collecting surface member, which extends transversely to the stream of fibers and which is subjected to suction. The fibers are deposited in a random orientation in a plane which is parallel to the collecting surface member. But a deposition of fibers over the thickness of the nonwoven web will assist the formation of thicker nonwoven webs and for this reason said known apparatuses are less suitable for the making of bulky random-laid nonwoven webs having a low density.

If the stream of fibers which fly from the opening roller is not directed to a sieve belt which extends transversely to the stream of fibers, but is caught in the generally triangular space between two sieve drums, which revolve in mutually opposite senses and are subjected to suction in the generally triangular space, and the nonwoven web forming on the sieve drums is conveyed away between said drums, it will be possible to ensure symmetrical relations as regards the surface structure of the nonwoven web but the conditions which affect the density of the nonwoven web will be similar to those obtained if a sieve belt is used as a collecting surface member.

SUMMARY OF THE INVENTION

For this reason it is an object of the invention so to improve with simple means an apparatus which is of the kind described first hereinbefore and serves to make nonwoven webs that bulky random-laid nonwoven webs having a low density can be made with a high uniformity.

The object set forth is accomplished in accordance with the invention in that a guide roller, which is driven to rotate in a sense that is opposite to that of the opening roller, is provided at a vertical distance from the fiber-receiving portion and in a peripheral region which faces the opening roller has a deflecting surface for deflecting a part of the fibers which fly from the opening roller whereas in a peripheral portion which succeeds in the direction of rotation constitutes a suction zone, which faces said fiber-receiving portion of the collecting surface member, and guide means for controlling in the direction of movement of the collecting surface member the air stream sucked through the collecting surface member are provided adjacent to the suction box.

The deflecting surface of the guide roller provided above the collecting surface member deflects a part of the stream of fibers flying from the opening roller and at the same time brakes the fibers to reduce their velocity of flight. In conjunction with the succeeding suction zone of the guide roller that braking permits a part of the stream of fibers to be temporarily retained on the guide roller in such a manner that said temporarily retained fibers and the fibers deposited on the fiber-receiving portion of the collecting surface member ensure the formation of a bulky random-laid nonwoven web which has a low density and is conveyed away through the guiding gap between the collecting surface member and the guide roller. Owing to the division of the entraining air stream into a part which is sucked through the collecting surface member and a part which is sucked by the guide roller, the dynamic pressure acting adjacent to each of the suction zones is reduced and that reduction of pressure has a direct effect on the density of the deposited fibers, which density depends on the dynamic pressure. The surfaces of the nonwoven web on both sides thereof are smoothened to a comparable degree by the collecting surface member and by the guide roller and this will not adversely affect the low density over the thickness of the nonwoven web. The distribution of the air stream which is sucked through the fiber-receiving portion in the direction of movement of the revolving collecting surface member has a significant influence on the deposition of fibers on the fiber-receiving portion so that said guide means which are provided adjacent to the suction box and control the distribution of the air stream can ensure in each case the optimum conditions of flow in the region in which the fibers are entrained.

Various designs may be adopted for the means for guiding the air stream which is sucked by the collecting surface. Said guide means may comprise, e.g., a cover provided on the suction box and facing the collecting surface member and formed with flow passages which differ in size in the direction of movement of the fiber-receiving portion of the revolving collecting surface member. But particularly simple conditions will be established if the guide means consist of at least one guide wall, which extends over the width of the fiber-receiving portion transversely to the direction of movement of the fiber-receiving portion of the revolving collecting surface member and is mounted to be rotatable about an axis which is parallel to the fiber-receiving portion and transverse to said direction of movement thereof. In that case the division of the air stream sucked through the collecting surface member into the suction box to the two flow passages disposed on both sides of the guide wall can be controlled by a pivotal adjustment of that guide wall. An additional adjustment may be effected by an adjustment of the axis of rotation of the guide wall in the direction of movement of said fiber-receiving portion of the revolving collecting surface member.

A uniform conveyance of the fibers within the entraining air stream is essential for the formation of a uniform nonwoven web. To permit an additional influence to be exerted on the conditions of flow, particularly adjacent to the fiber-receiving portion of the collecting surface member, a feature of the invention resides in that an additional air supply gap, which is adapted to be controlled by a valve flap, is provided between the collecting surface member and a guard provided on that side of the opening roller which faces the collecting surface member so that the suction zone of the collecting surface member is adapted to suck through said additional air supply gap the air which serves to influence the deposition of fibers. The rate at which the additional air is supplied can be adjusted by the additional air supply valve flap.

Finally, that boundary wall of the suction box which is provided on the trailing side with respect to the movement of the fiber-receiving portion of the revolving collecting surface member may be mounted to be adjustable in the direction of movement fiber-receiving portion of the revolving collecting surface member so that the length of the fiber-receiving portion subjected to suction can be adapted to the conditions in each case. The resulting change of the width of the opening of the suction box which faces the fiber-receiving portion generally requires a readjustment of the guide wall.

BRIEF DESCRIPTION OF THE DRAWING

The invention is illustrated by way of example in the drawing, which is a schematic longitudinal sectional view showing a portion of an apparatus in accordance with the invention for making a nonwoven fabric.

DETAILED DESCRIPTION OF THE PREFERRED EMBODIMENT

In the embodiment illustrated by way of example the apparatus for making a nonwoven web comprises in a conventional manner a toothed opening roller 1, which is supplied with a lap, e.g., over a trough-shaped deck. The fibers which have been combed out of the lap by the opening roller 1 are additionally disintegrated by pairs of worker and clearer rollers 2 so that individual fibers are thrown under centrifugal force from the opening roller 1 with the assistance of an entraining air stream 3, which is tangential to the opening roller 1 and is sucked by a fan, not shown, and supplied to the opening roller 1 through a flow passage 4. A revolving air-permeable collecting surface member 5 is provided below the opening roller 1 and has a flat fiber-receiving portion 6, which is subjected to suction. For that purpose a suction box 7 is provided on that side of the fiber-receiving portion 6 which is remote from the opening roller 1.

A perforated guide roller 8 is spaced above the fiber-receiving portion 6 on that side of the stream of flying fibers which is remote from the opening roller 1. That guide roller 8 is driven to rotate in a direction which is opposite to the direction of rotation of the opening roller 1 circumferential portion 9 of guide roller 8 faces the opening roller 1 and constitutes a deflecting surface for deflecting a part of the fibers flying from the opening roller 1. A circumferential portion which in the direction of rotation succeeds that deflection surface constitutes a suction zone 10. The suction zone faces the fiber-receiving portion 6 of the collecting surface member 5 to subject fiber-receiving portion 6 to suction. That suction zone 10 is constituted by a suction insert 11 in the guide roller 8 and can be pivotally adjusted about the axis of rotation of the guide roller 8 to an optimum angular position, as indicated by double-headed arrow 10*a*. Because the collecting surface member 5 and the guide roller 8 are both subjected to suction, the entraining air stream is divided into two partial streams, which are sucked by the suction zone 10 of the guide roller 8 and through the fiber-receiving portion 6 of the collecting surface member 5. As a result, the fibers of the stream of fibers thrown from the opening roller 1 are in part temporarily retained on the suction zone 10 of the guide roller 8, on the one hand, and on fiber-receiving portion 6, on the other hand. In conjunction with the deflection of the fibers by the circumferential portion 9 of the guide roller 8 that division of the stream of fibers results in the formation of a bulky nonwoven web having a low density. The web is guided through gap 12 between guide roller 8 and collecting surface member 5 which moves in a direction indicated by arrow 5*a*. The deposition of the fibers on member 5 to form the web is additionally adjustable if the guide roller 8 is displaceable at right angles to the fiber-receiving portion 6 of the collecting surface member 5, and parallel to the direction of movement of the revolving collecting surface member 5.

The deposition of fibers on the fiber-receiving portion 6 of the collecting surface member 5 will obviously be influenced by the conditions of flow above the fiber-receiving portion 6 of the collecting surface member 5. To ensure desirable conditions for the deposition, the distribution of the air stream over the length of the fiber-receiving portion 6 measured in the direction of movement of the revolving collecting surface member 5 is controlled by guide means 13 near the fiber-receiving portion 6 adjacent to the suction box 7. In the embodiment shown by way of example guide means 13 consist of a guide wall 14, which extends over the width of the fiber-receiving portion 6 transversely to the direction of movement of the revolving collecting surface member 5. Guide wall 14 is pivotally adjustable about an axis 15, as indicated by double-headed arrow 15*a*. Axis 15 extends in a direction which is parallel to the fiber-receiving surface 6 and transverse to the direction of movement of the revolving collecting surface member 5 and is displaceable in this direction, as indicated by double-headed arrow 14*a*. By that guide wall 14 the opening 16 which is defined by the suction box 7 on its side facing the collecting surface member 5 is divided into two flow passages, in which the conditions of flow are appreciably influenced by the adjusted position of the guide wall 14. As a result, the air stream which is sucked through the fiber-receiving portion 6 into the suction box 7 is distributed to the flow passages provided on both sides of the guide wall 14. Depending on the adjustment of guide wall 14, the conditions of flow above the fiber-receiving portion 6 and the resultant conditions for the deposition of fibers on the fiber-receiving portion 6 will be varied. In addition, boundary wall 17 of suction box opening which is disposed on the trailing side with respect to the movement of the fiber-receiving portion 6, is adjustable in said direction of movement so that the width of the opening 16 can be adjusted (see phantom lines and double-headed arrow 17*a*). For control of the flow rate of the air stream which is sucked through the collecting surface member 5 the suction box 7 may also be provided with a sliding throttle valve 18.

A further influence on that partial stream of fibers which are supplied to the collecting surface member 5 may be exerted adjacent to the fiber-receiving portion 6 if an additional air supply gap 20 is defined by and between the collecting surface member 5 and a guard 19 for the opening roller 1 so that additional air is sucked through said additional air supply gap 20 by the suction box 7. That additional air will assist a uniform deposition of the fibers on the collecting surface member 5 in the leading part of the fiber-receiving portion 6. For a control of that stream of additional air through the additional air supply gap 20 the latter is adapted to be closed by a valve flap 21, which is shown in the drawing in its closed position by solid lines and in its open position by dash-and-dot lines.

I claim:

1. In an apparatus for making a nonwoven web comprising an air-permeable collecting surface member operable to revolve in a direction of movement and having an at least substantially flat fiber-receiving portion having a width extending transversely to the direction of movement, a toothed opening roller disposed on one side of said collecting surface member and operable to open a lap of fibers, the opening roller being adapted to be driven to rotate in a predetermined direction at a surface speed which is sufficient to cause the fibers of said lap to be thrown from said opening roller under centrifugal force in a stream of fibers onto the collecting surface member, and a suction box adjacent to said fiber-receiving portion on a side of said collecting surface member which is remote from said opening roller, which suction box has an opening facing the fiber-receiving portion and is operable to suck through said fiber-receiving portion a stream of air for entraining the stream of fibers thrown from said opening roller, the improvement comprising a guide roller disposed on the one side of said collecting surface member and vertically spaced from said fiber-receiving portion, the guide roller being operable to rotate in a direction opposite to that of said opening roller and having a leading circumferential surface portion facing said opening roller and projecting into the stream of fibers to deflect a part of the fibers thrown from said opening roller and a trailing circumferential surface portion facing said fiber-receiving portion and constituting a suction zone, and guide means in said suction box opening for distribution of said air stream sucked through said fiber-receiving portion in the direction of movement of the collecting surface member.

2. The improvement set forth in claim 1, wherein said guide means consists of at least one guide wall extending transversely to said direction of movement over the width of the fiber-receiving portion and mounted to be angularly adjustable in the suction box opening about a pivotal axis, the pivotal axis being parallel to said fiber-receiving portion and extending transversely to said direction of movement.

3. The improvement set forth in claim 2, wherein said pivotal axis of said guide wall is displaceable in said direction of movement.

4. The improvement set forth in claim 1, further comprising a guard for said opening roller disposed between the opening roller and said collecting surface member, said guard and said collecting surface member defining between them an additional air supply gap extending over the width of said fiber-receiving portion, and a valve flap adapted to close said additional air supply gap.

5. The improvement set forth in claim 1, further comprising a boundary wall for said suction box opening on a trailing side of the opening with respect to said direction of movement, the boundary wall being mounted to be adjustable in said direction of movement.

* * * * *